US005249918A

United States Patent [19]

Knorowski

[11] Patent Number: 5,249,918

[45] Date of Patent: Oct. 5, 1993

[54] APPARATUS AND METHODS FOR MINIMIZING OR ELIMINATING SOLID PARTICLE EROSION IN DOUBLE-FLOW STEAM TURBINES

[75] Inventor: Victor J. Knorowski, Rexford, N.Y.

[73] Assignee: General Electric Company, Schenectady, N.Y.

[21] Appl. No.: 814,887

[22] Filed: Dec. 31, 1991

[51] Int. Cl.[5] ..... F01D 5/14

[52] U.S. Cl. ..... 415/108; 415/209.2; 415/209.3

[58] Field of Search ..... 415/108, 209.2, 209.3, 415/189, 190, 191, 208.1

[56] References Cited

U.S. PATENT DOCUMENTS

| | | | |
|---|---|---|---|
| 4,015,910 | 4/1977 | Harmon et al. | 415/209.2 |
| 4,029,432 | 6/1977 | Meylan et al. | 415/108 |
| 4,634,340 | 1/1987 | Stetter | 415/115 |
| 4,764,084 | 8/1988 | Parker et al. | 415/102 |
| 4,776,765 | 10/1988 | Sumner et al. | 415/181 |
| 5,024,579 | 6/1991 | Groenendaal, Jr. | 415/108 |
| 5,104,285 | 4/1992 | Groenendaal, Jr. | 415/108 |

FOREIGN PATENT DOCUMENTS

| | | | |
|---|---|---|---|
| 901584 | 1/1982 | U.S.S.R. | 415/169.2 |
| 1086191 | 4/1984 | U.S.S.R. | 415/108 |

OTHER PUBLICATIONS

"Reducing Solid Particle Erosion Damage in Large Steam Turbines" Sumner et al., GE Turbine Reference Library, Copyright 1985, General Electric Co.

*Primary Examiner*—John T. Kwon

*Attorney, Agent, or Firm*—Nixon & Vanderhye

[57] ABSTRACT

The reheat tub in a double-flow steam turbine is provided with additional setback from the rotor buckets by forming a three-part reheat tub construction including first and second discrete diaphragm segments and third inner ring segments. The annular arrays of these segments are dimensioned to enable greater axial spacing between the nozzles and buckets. To refurbish an in-service double-flow turbine, the damaged reheat tub is removed and cut along axial and radial part lines to form discrete first and second diaphragm segments. The diaphragm segment nozzles are then refurbished by adding weld material and machined to the appropriate configuration. Material is added to the downstream and removed from the upstream faces of each diaphragm so that it may be located in the turbine shell similarly as the removed tub, but with the nozzles spaced further axially upstream of the buckets.

7 Claims, 2 Drawing Sheets

FIG. 3
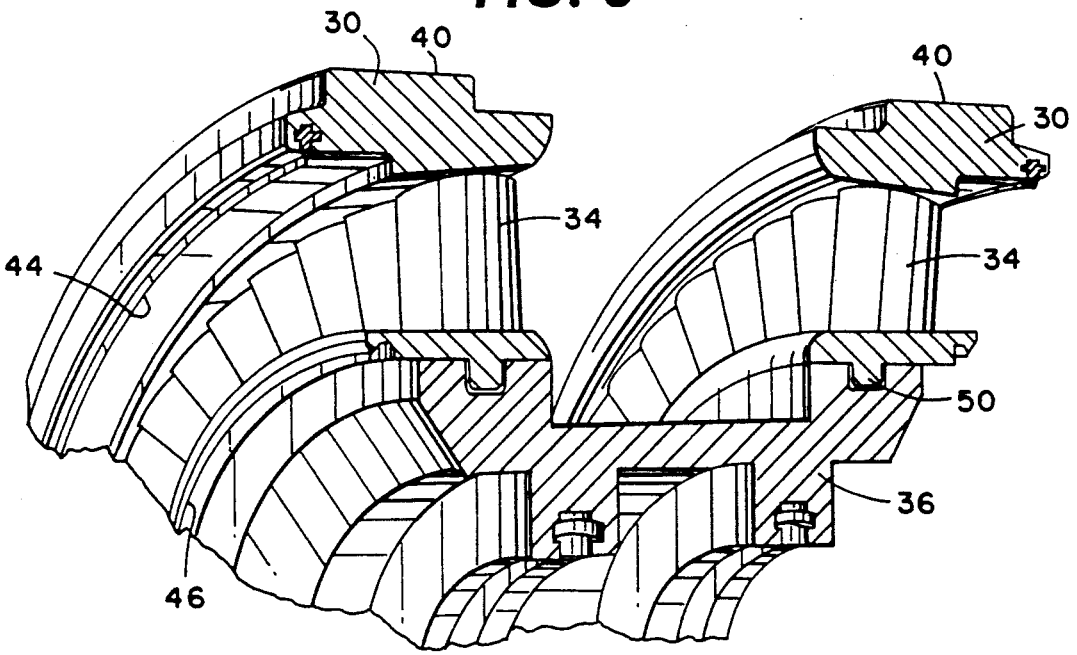
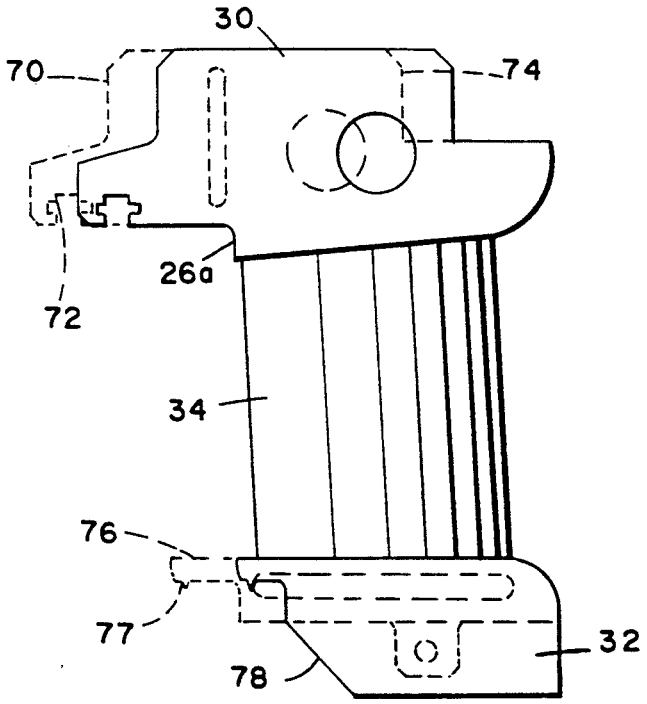
FIG. 4

APPARATUS AND METHODS FOR MINIMIZING OR ELIMINATING SOLID PARTICLE EROSION IN DOUBLE-FLOW STEAM TURBINES

BACKGROUND AND SUMMARY OF THE INVENTION

The present invention relates to apparatus and methods for minimizing or eliminating solid particle erosion damage in double-flow steam turbines and particularly relates to apparatus and methods for eliminating or minimizing such damage in the reheat tubs of double-flow steam turbines by providing additional axial setback of the first-stage nozzles from the first-stage rotor buckets.

In steam turbines, solid particle erosion damage to both stationary and rotating components in the steam path has become a very significant problem. The problem is exacerbated as the average in-service age of the steam turbines increases. It is known that a principal source of such erosion damage is the existence of iron oxide particles in the steam resultant from the exfoliation of oxides formed on the inner surfaces of the steam boiler tubes and steam piping at elevated temperatures and which particles impact on the nozzles and buckets along the steam paths. This solid particle erosion damage in steam turbines is a major contributor to problems associated with the operation and maintenance of steam turbines, for example, those used by utilities to generate electrical power. These problems include loss of sustained efficiency, forced outages, extended maintenance outages, cost of maintenance, cost of replacement parts and shortened inspection intervals. In fact, solid particle erosion damage has become such a contributing factor in the utilization of steam turbines for the generation of electrical power that a dollar cost per kilowatt hour per year is frequently assigned to this phenomena.

Efforts, of course, have been made to minimize or eliminate this problem. One approach has been to eliminate the source of the solid particles themselves, for example, by providing a chromium diffused layer on the internal surfaces of boiler tubes to inhibit formation of the oxides. While this solution may be effective in new steam turbines, it is not applicable for practical and cost considerations to units in-service. Other attempted solutions include acid cleaning of superheaters and reheaters to remove scale from the tube surfaces, and chromating boiler tubes. However, such methods to eliminate the problem at its source have proven expensive and are oftentimes not practical.

Another approach to the solid particle erosion problem has been to produce steam path designs which are effective to resist such erosion. Recent studies have shown that the location and intensity of the particles impacting on the nozzles and buckets are the leading causes of erosion. For example, in the reheat section of a turbine steam path, the nozzles erode from the suction surface, particularly along their trailing edges as a result of particle collision with a leading edge of the bucket and rebound into the nozzle trailing edge suction surface. It is also known that the nozzle erosion caused by such particle rebounding phenomena may be significantly reduced or eliminated by increasing the axial clearance between the nozzles and buckets. This increased clearance affords more time for steam to accelerate the particles as they proceed from the nozzles to the buckets and for the steam to redirect the particles back toward the buckets after collision with the bucket leading edges. Thus steam turbines have previously been designed with increased setback of the nozzles relative to the buckets. That is, the diaphragms of steam turbines where solid particle erosion is or is anticipated to be a problem, have been moved upstream relative to the buckets to increase the axial spacing therebetween and hence minimize or eliminate the problem.

With respect to double-flow reheat turbines, however, the provision of additional setback is replete with difficulties, particularly when modifying or retrofitting an existing reheat tub to provide such additional setback. Practical problems such as imperfections in original welds, the use of filler pieces to limit welding distortion in the original fabrication and a general inability to modify various components of the double-flow tub without causing other problems, for example, relocating external cooling pipes or upsetting rotor balance access ports, presents a formidable task if additional nozzle setback is desired in double-flow reheat tubs.

According to the present invention there is provided novel and improved apparatus and methods for providing additional setback, i.e., increased axial clearance between the diaphragms and rotors of the first stages in a double-flow steam turbine. Particularly, the present invention provides a three-part reheat tub construction for the first stages of a double-flow steam turbine and which construction is useful to provide additional setback in both new double-flow steam turbines as well as double-flow steam turbines in-service which have been damaged by solid particle erosion. According to the present invention, the new and improved reheat tub includes, as two of its three parts, first and second discrete annular diaphragms each comprised of inner and outer rings and a plurality of circumferentially spaced nozzles extending radially between the inner and outer rings. The third part of the new and improved three-part reheat tub according to the present invention includes an inner cylinder which, in assembly, spans axially between the first and second diaphragms. It will be appreciated that each diaphragm is comprised of a plurality of arcuate segments assembled end to end to form the complete annular diaphragm. Thus, each annular diaphragm comprises two or more arcuate diaphragm segments connected to one another. Similarly, the inner cylinder is comprised of two or more arcuate segments connected end to end to one another to form the cylinder. Preferably, however, each segment extends for approximately 180° whereby each diaphragm is formed of two arcuate diaphragm segments and the inner cylinder is formed of two arcuate inner cylinder segments. It will be understood, therefore, that the reheat tub is comprised of a three-part construction, two discrete diaphragms spaced axially one from the other along a third part, i.e., the inner cylinder, notwithstanding each of the parts is formed of two or more segments.

To assemble a three-part reheat tub according to the present invention, each of the diaphragm segments is provided at its opposite ends, with keys, i.e., the keys are located approximately 180° apart adjacent the end faces of the discrete segments. Rabbet fits or keyways are formed in the radially outermost surfaces of the inner cylindrical segments to receive the mating rabbets or keys. By bolting separate locking keys in the keyways, the segments may be assembled. Conventional steam seals are likewise provided at the junctures of the diaphragm segments and the inner cylinder segments.

The three-part reheat tub hereof can be dimensioned, for use in a new turbine to provide a predetermined setback (increased in comparison with conventional setbacks) and can also be used to refurbish in-service turbines damaged by solid particle erosion to provide an additional setback in comparison with the setback originally provided the turbine. Thus, for new turbines, the reheat tub is formed in three discrete parts, i.e., discrete first and second annular diaphragms and a discrete inner cylinder, with the parts being originally dimensioned to provide the necessary additional setback to minimize or eliminate the solid particle erosion problem in the new double-flow steam turbine.

The three-part reheat tub design of the present invention is also particularly useful in refurbishing in-service double-flow steam turbines which have been damaged by solid particle erosion or otherwise. To accomplish this, the reheat tub of the in-service turbine is removed from the turbine. That is, the conventional one piece cast tub, two piece bolted tub, or two piece saddle tub, as applicable, is removed from the damaged turbine. A new reheat tub comprised of entirely new parts formed in the three-part design hereof, may be installed in lieu of the damaged reheat tub. These new parts including the new discrete first and second diaphragms and new inner cylinder may be dimensioned to provide the additional setback and for fit within the existing turbine. While installation of entirely new parts of the three piece design may be used, cost and other considerations indicate that at least some elements of the removed and damaged reheat tub may be refurbished and reused in the refurbished tub construction.

To accomplish this, each arcuate section of the removed and damaged reheat tub is cut generally along radial and axially extending part lines into three pieces, namely, an inner cylindrical portion and two diaphragm segments, each diaphragm segment including inner and outer ring portions and radially extending nozzles between the inner and outer ring portions. The nozzles of the removed diaphragm segments may then be refurbished to repair the damage caused by solid particle erosion. Particularly, each nozzle may be repaired by adding material to it, such as by welding or by the installation of a pre-formed coupon, and subsequently machining the added material to the appropriate shape such that the original nozzle design may be obtained.

Further, the downstream faces of both the inner and outer ring portions of each diaphragm segment are provided with additional material, for example, added by welding. The added material is later machined to the appropriate shape. In this manner, the axial spacing between the trailing edges of the refurbished nozzles and the downstream faces of the inner and outer ring portions is increased. Conversely, material on the upstream face of the outer ring portions is removed. It will be appreciated that, by adding material to the downstream faces of the inner and outer ring portions and removing the material from the upstream face of the outer ring portions, the net result of the material added and subtracted is to locate the nozzle a greater axial distance from the rotor buckets and without changing the tub mounting locations. Thus, the generally radially outwardly projecting circumferential flanges of the diaphragm segments may be received in the original corresponding grooves of the shell forming part of the steam inlet torus without relocating those grooves.

The inner cylindrical portion of the damaged reheat tub is replaced by a newly fabricated inner cylindrical ring comprised of at least a pair of arcuate inner segments. Each inner segment includes a rabbet fit or keyway opening radially outwardly for receiving mating rabbets or keys projecting radially inwardly from the inner ring portions of the diaphragm segments. To form the rabbets or keys, the inner ring portions of the removed reheat tub are further machined along their inside surfaces to remove material. Consequently, when the refurbished diaphragms and the new inner cylinder are applied to the turbine in-service, the flanges of the outer ring portions of the diaphragm segments are located in the grooves of the shell and thereby locate the nozzles of the diaphragms predetermined, increased axial distances from the buckets of the first-stage rotors. By then applying the inner ring segments with the interfitting keys and keyways, a newly refurbished reheat tub is provided. It will be appreciated that other necessary elements of the new inner segments may likewise be provided, for example, radially inwardly projecting dovetails for receiving the mating parts for the seal packings of the turbine rotor.

By using a three-part construction, the additional setbacks for the first-stage diaphragms of double-flow steam turbines may be provided for new turbines as well as in-service turbines damaged by solid particle erosion or otherwise. This three-part construction affords numerous advantages. It permits setback of both diaphragms in a double-flow turbine which previously was difficult if not impossible to accomplish without causing distortion. Further, the three-part construction is less costly to fabricate when new turbines with additional setback in their reheat tubs are manufactured. Importantly, existing double-flow steam turbines can be readily, easily, and relatively inexpensively retrofitted with reheat tubs with additional setback without problems associated with thermal distortion from use. Such problems include thermal expansion of the various elements of the tub at different rates, problems associated with residual structural stresses and oxide build-up and thermal warpage. From a time standpoint, the diaphragm segments may be refurbished substantially simultaneously thus reducing the turbine downtime.

Therefore, in accordance with a first aspect of the present invention, there is provided, in a double-flow steam turbine having an axis and a reheat tub, discrete first and second arcuate diaphragm segments axially spaced one from the other and disposed about the turbine axis. Each diaphragm segment has an outer ring portion, an inner ring portion and a plurality of nozzles circumferentially spaced one from the other about the axis and between the ring portions whereby the nozzles of the axially-spaced segments define steam paths in generally axially opposite directions relative to one another. A discrete arcuate inner segment is disposed about said axis and extends axially between the inner ring portions of the axially spaced diaphragm segments. Means are provided cooperable between each of the diaphragm segments and the inner segment for securing the diaphragm segments and the inner segment one to the other whereby said diaphragm segments and the inner segment may be secured to one another within the turbine.

In accordance with another aspect of the present invention, there is provided, in a double-flow steam turbine having two first-stage oppositely facing bucket rows and a damaged double-flow reheat tub including a plurality of axially spaced diaphragm portions and an inner cylindrical portion spanning between the diaphragm portions, a method of retrofitting a reheat tub with increased setback of the diaphragms relative to the two first-stage bucket rows on the rotor comprising the steps of removing the damaged reheat tub from the turbine, providing a reheat tub with increased setback having at least three discrete parts including (i) first and second arcuate diaphragm segments each having inner and outer ring portions and a plurality of circumferentially spaced nozzles therebetween and (ii) an inner segment, and assembling the reheat tub with increased setback in the turbine by securing the diaphragm segments and the inner segment one to the other with the diaphragm segments spaced axially one from the other along the inner segment thereby affording increased setback relative to the respective axially adjacent first-stage rotors.

In a further aspect of the present invention when refurbishing an in-service steam turbine, the above method may include the further steps of forming the discrete first and second arcuate diaphragm segments by separating the diaphragm portions of the removed and damaged reheat tub from the inner cylindrical portion thereof, and refurbishing the separated diaphragm portions to form the first and second diaphragm segments whereby the assembled reheat tub with increased setback includes diaphragm segments formed from the diaphragm portions of the removed and damaged reheat tub. The refurbishing preferably includes the addition and subtraction of material from the diaphragm segments.

Accordingly, it is a primary object of the present invention to provide novel and improved apparatus and methods for providing, in double-flow steam turbines, a reheat tub which affords additional setback from the first-stage rotors for minimizing or eliminating solid particle erosion in the first stages.

These and further objects and advantages of the present invention will become more apparent upon reference to the following specification, appended claims and drawings.

BRIEF DESCRIPTION OF THE DRAWINGS

FIG. 3 is a view similar to FIG. 1 illustrating a three-part reheat tub for a double-flow steam turbine and constructed in accordance with the present invention; and FIG. 4 is an enlarged fragmentary cross-sectional view of a diaphragm portion removed from an in-service turbine illustrating the material additions and deletions necessary to retrofit the in-service turbine with a modified reheat tub having additional setback in accordance with the present invention.

DETAILED DESCRIPTION OF THE DRAWING FIGURES

Reference will now be made in detail to a present preferred embodiment of the invention, an example of which is illustrated in the accompanying drawings.

Figure 1:
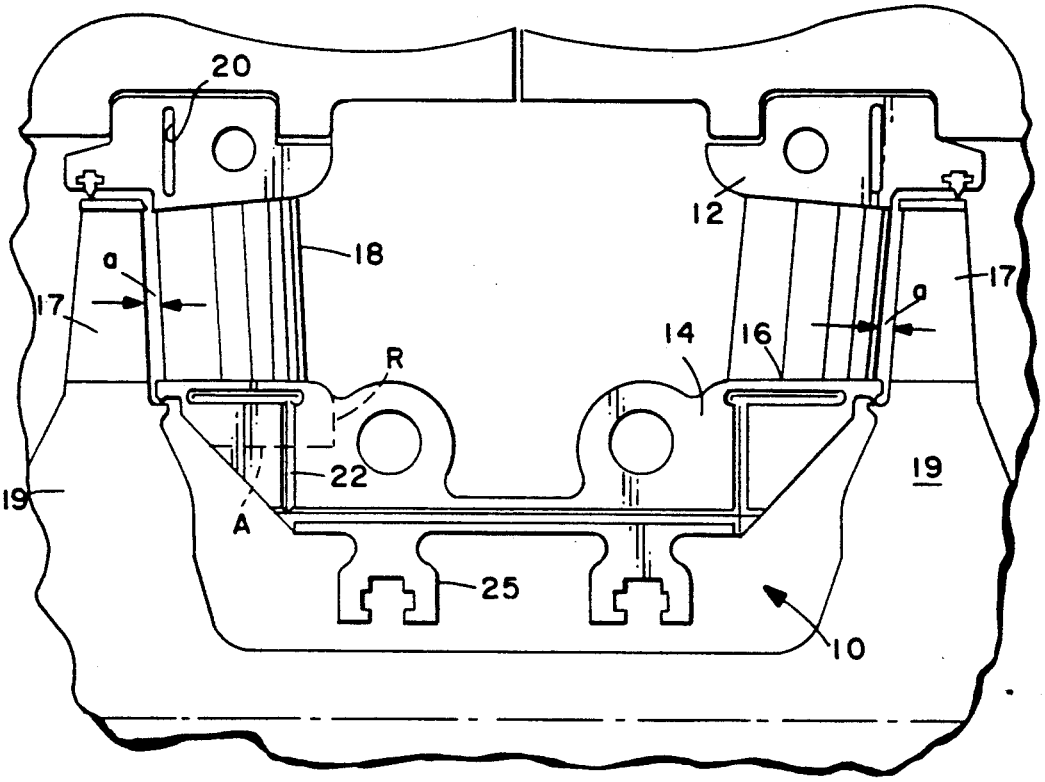
FIG. 1 (PRIOR ART)
FIG. 1 is a fragmentary end elevational view of a portion of a prior art reheat tub forming part of a double-flow steam turbine.

Referring now to FIG. 1, there is illustrated in end elevation a portion of a conventional reheat tub T, generally designated 10, for a double-flow steam turbine. Reheat tub 10 includes two or more arcuate sections, one end face of one of the sections being illustrated in end elevation. The sections, when assembled with one or more other sections in a circular array, form an annular tub about the axis of the double-flow steam turbine. Each section of tub 10 includes an outer ring portion 12, an inner cylindrical portion 14 having axially spaced ends forming inner surface portions 16 and a plurality of circumferentially spaced nozzles 18 extending generally radially between the inner and outer portions 12 and 16. In this prior art construction, each arcuate tub section may comprise an integral one piece casting or a pair of castings substantially forming mirror images of one another and bolted together along a plane substantially normal to the axis of the turbine. There is also in the prior art a two piece saddle design where one diaphragm and the inner cylinder are integral with one another and the axially opposite diaphragm is a separate piece secured to the inner cylinder.

In FIG. 1, the nozzles 18 are illustrated at a predetermined axial spacing "a" relative to the buckets 17 of the first-stage rotor 19. Also, as illustrated in FIG. 1, the end face of tub 10 is provided with key slots 20 and 22 for receiving seals, not shown, when the arcuate sections of the tub are assembled to prevent steam leakage through the circumferentially-spaced joints of the circular tub. Inner cylinder 14 is also provided with a pair of inwardly extending, axially spaced, dovetails 25 for connecting with the rotor seal packings, similarly not shown. As indicated previously, solid particle erosion, particularly with respect to the trailing edge of the nozzles 18, may be minimized or eliminated by increasing the axial spacing "a" between the nozzles and buckets of the first stage, i.e., increasing the setback of the nozzles relative to the buckets.

Figure 2:
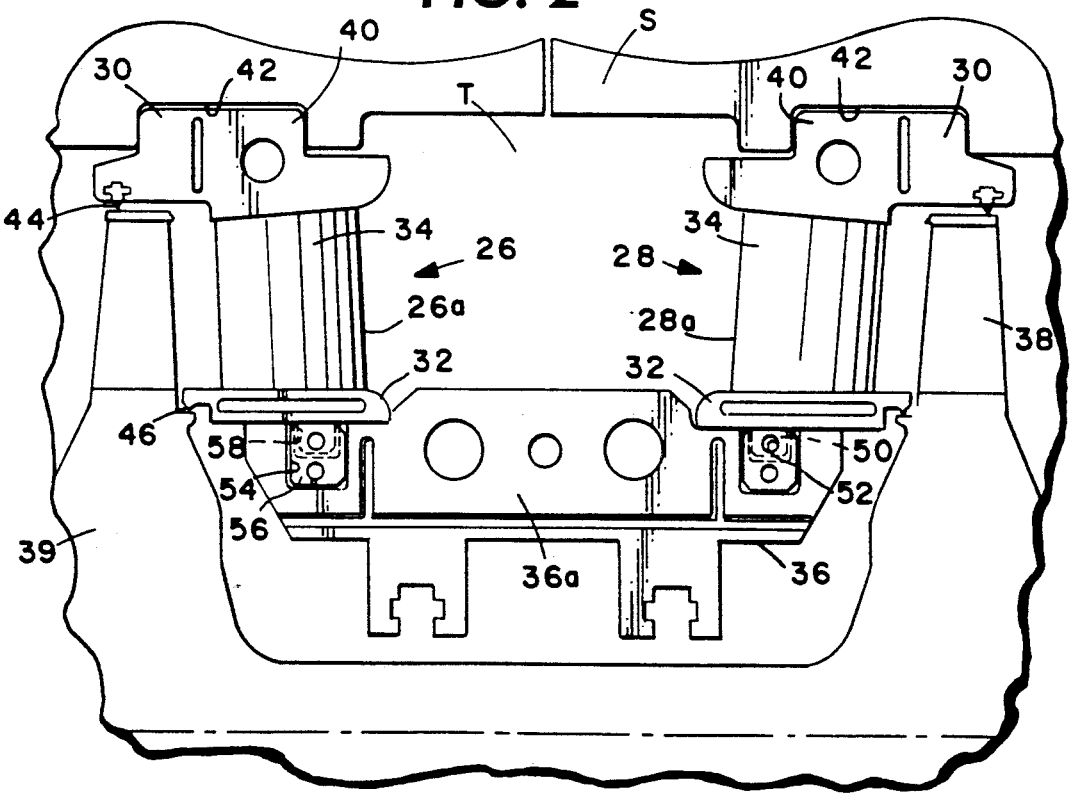
FIG. 2 is a fragmentary perspective view with parts in cross-section illustrating schematically a three-part reheat tub construction according to the present invention.

Referring now to FIGS. 2 and 3, there is illustrated a three-part reheat tub construction according to the present invention. The first two parts comprise a pair of diaphragms generally designated 26 and 28. Each diaphragm includes a plurality of arcuate diaphragm segments assembled to form the annular diaphragm. That is, each segment **26*a* and 28*a* forms a portion of an annular array of similar segments which form the diaphragms 26 and 28. The diaphragms are, of course, located on opposite sides of a torus 30 which supplies steam to the double-flow turbine. Each segment 26*a* and 28*a* includes an outer ring portion 30, an inner ring portion 32 and a plurality of nozzles 34 circumferentially spaced one from the other about the segment and extending generally radially between the outer and inner ring portions 30 and 32**, respectively.

The third part of the three-part construction of a reheat tub according to the present invention includes an inner cylinder 36 comprised of a plurality, preferably a pair, of arcuate inner cylinder segments **36*a*. Each inner segment 36*a* has an axial extent spanning between diaphragm segments 26*a* and 28*a*, and, when assembled in an annular array, the inner segments 36*a* define with the outer shell S and diaphragms 26 and 28, the inlet steam torus 30 for supplying steam through nozzles 34 to the buckets 38** of the first-stage rotors.

Each outer ring portion 30 has a radially outwardly projecting flange 40 for reception within a corresponding groove 42 of the shell which serves, among other purposes, to locate the nozzles relative to the buckets. The downstream or trailing edges of the outer and inner ring portions 30 and 32, respectively, carry sealing blades 44 and 46 for engagement with rotors and flanges on the rotor bodies 39, respectively.

A particular feature of the present invention is that each of the three parts forming the tub construction hereof, i.e., diaphragms 26 and 28 and inner cylinder 36, is a discrete part. Additionally, each arcuate section of the reheat tub is likewise of a three-part design, i.e., the arcuate segments 26*a* and 28*a* and the arcuate inner cylinder segment 36*a*. That is, the segments are not integral, have unique identity and form the reheat tub only on final assembly.

Means are provided cooperable between each of the diaphragm segments and the inner segments for securing the diaphragm segments and the inner segments one to the other. Such securing means includes a radially inwardly directed key 50 carrying a bore hole 52 at each of the opposite ends of each diaphragm segment adjacent its juncture with an adjoining segment. The securing means also includes on each inner segment 36 a radially outwardly opening groove 54 in which is disposed a key 56 covering the end of the rabbet fit 58 and rabbet 50. Thus, the flanges 40 of the outer ring portions of diaphragms 26 and 28 are located in assembly in the respective grooves 42 in shell S while the inner ring portions of diaphragms 26 and 28 are located in assembly by the cooperation of the keys 56, keyways 54, rabbet fit 58 and rabbet 50. The locking keys 56 are held in place by a pair of bolts and bolt holes 52 which interconnect all pieces of the tub T.

When a reheat tub in an in-service turbine has been damaged by solid particle erosion or otherwise necessitating its replacement, and it is desired to provide a replacement tub with additional setback, a wholly new three-part reheat tub, dimensioned to provide such additional setback, may be used. It has been found, however, that such replacement is extremely costly and oftentimes impractical.

Therefore, in accordance with another aspect of the present invention, setback modification of the reheat tub of a double-flow steam turbine in-service may be accomplished by refurbishing at least portions of the damaged reheat tub and using those refurbished portions in the replacement reheat tub with the additional setback. To accomplish this, the damaged reheat tub is first removed from the turbine. In accordance with the present invention, the diaphragm portions of the removed reheat tub may be refurbished and reused in the replacement reheat tub with additional setback in the following manner. The damaged diaphragm portions of the arcuate sections of the removed reheat tub are cut along generally axial and radial part lines indicated by the dashed lines A and R in FIG. 1 to separate the damaged diaphragm portions from the inner cylindrical portions and to form, when refurbished, new diaphragm segments for use in the new reheat tub with additional setback. The nozzles of each separated diaphragm portion may then be refurbished to eliminate the erosion caused by the solid particles. Particularly, weld material may be added to the nozzles as necessary, for example, along their trailing edges. The nozzles are then machined into the appropriate configuration.

To provide for the additional setback of the nozzles of the refurbished tub relative to the buckets, while simultaneously enabling use of the grooves 42 in the shells as locating grooves, material is added and removed with respect to the outer and inner ring portions 30 and 32, respectively, of the removed diaphragm segments as illustrated in FIG. 4. Particularly, material may be added to the downstream or trailing edges of the outer ring portions, as illustrated by the dashed lines 70, for example, by adding weld material. After the material has been added, the surfaces may be machined to the desired configuration. Note also that the dovetail grooves 72 for holding the sealing blades 44 are similarly relocated by machining new grooves in the added material such that, in assembly, the sealing blades 44 will align with the rotors. The extent of the material removed from the upstream faces of the outer ring portions 36 is indicated by the area between the dashed lines 74 and the peripheral solid lines.

Material is also added to the downstream or trailing edges of the inner ring portions 32 as indicated by the dashed lines 76 in FIG. 4. New mountings 77 for the sealing blades 46 are also formed in the material added at 76 such that, when the diaphragm segments 26*a* and 28*a* are in assembly, sealing blades 46 will overlie the flanges on the rotors in sealing relation therewith. Also illustrated by the dashed lines 78 in FIG. 4 is the material along the radially inwardly directed face of inner ring portions 32 which has been removed. As illustrated in FIG. 1, the part lines A leave sufficient material along the underside of the inner ring portions 32 such that material may be machined away to form the rabbets 50 on the inner ring portions 32.

Consequently by adding material on the downstream faces of the inner and outer ring portions, and removing material on the upstream faces of the outer ring position and the inner surface of the inner ring portion 30, the trailing edges of the nozzles may be relocated axially upstream from the leading edges of the buckets. This is accomplished, moreover, without necessitating relocation of the locating grooves 42 in the outer shell. Moreover, inner segment 36 is a new piece and is machined to accommodate the rabbets 50 projecting from the radially inner faces of the inner ring portions 32 of diaphragm segments 26 and 28. Consequently, when the three parts of the refurbished tub, i.e., the two refurbished diaphragms 26 an 28 and the new inner cylinder 36 are assembled, the nozzles of the refurbished diaphragms will have additional setback from the leading edges of the buckets.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a double-flow steam turbine having an axis, first-stage rotors spaced axially one from the other, a reheat tub disposed between said first-stage rotors and including first and second arcuate diaphragms axially spaced one from the other and disposed about said turbine axis, each said diaphragm having an outer ring portion, an inner ring portion and a plurality of nozzles circumferentially spaced one from the other about said axis and between said ring portions whereby the nozzles of said axially spaced diaphragms define steam paths in generally axially opposite directions relative to one another, said nozzles having trailing edges spaced a predetermined axial distance from said rotors, an inner ring portion disposed about said axis and extending axially between said inner ring portions of said axially spaced diaphragms, and stationary parts of said turbine carrying axially spaced mounting means for said first and second diaphragms, respectively; the improvement wherein said first and second diaphragms comprise discrete diaphragm segments with each segment including said outer ring portion, said inner ring portion and said nozzles therebetween, said inner ring portion comprising a discrete arcuate inner ring segment, means for establishing a spacing between the trailing edges of the nozzles of said segments greater than said predetermined axial distance to substantially avoid solid particle erosion damage of such trailing edges while maintaining the axial distance between said rotors constant, said means including material added to said diaphragm segments on the sides thereof in axial registration with said rotors and cooperable with said stationary mounting means to space the nozzles of the diaphragm segments said greater distance from the rotors and means cooperable between each of said diaphragm segments and said inner segment for securing said diaphragm segments and said inner segment one to the other whereby said diaphragm segments and said inner segment are secured to one another within said turbine.

2. A turbine according to claim 1 wherein said material is disposed on each of said outer and inner ring portions of said diaphragm segments.

3. A turbine according to claim 2 wherein said material comprises weld material.

4. A turbine according to claim 1 wherein said cooperable means is disposed between each of said inner ring portions and said inner segment.

5. A turbine according to claim 1 wherein said cooperable means includes keys and keyways formed between said diaphragm segments and said inner segment.

6. A turbine according to claim 5 wherein said keys are formed on said inner ring portions to project generally radially inwardly and said keyways are formed on said inner segment at axially spaced locations therealong and open generally radially outwardly to receive said keys.

7. A turbine according to claim 1 including a plurality of said first diaphragm segments, said second diaphragm segments and said arcuate inner segments, said plurality of said first diaphragm segments being disposed to form an annular array thereof, means for connecting said first diaphragm segments one to the other in said annular array thereof, said plurality of said second diaphragm segments being disposed to form an annular array thereof, means for connecting said second diaphragm segments one to the other in said annular array thereof, said plurality of said arcuate inner segments being disposed to form an annular array thereof, and means for connecting said arcuate inner segments one to the other in said annular array thereof.

* * * * *